United States Patent [19]

Bula

[11] 4,292,900

[45] Oct. 6, 1981

[54] ROTATABLE PALLET POST FOR PLASTIC PALLETS

[75] Inventor: Russell P. Bula, Whitby, Canada

[73] Assignee: E. I. Du Pont de Nemours and Company, Wilmington, Del.

[21] Appl. No.: 73,327

[22] Filed: Sep. 7, 1979

[30] Foreign Application Priority Data

Sep. 8, 1978 [CA] Canada ..... 310985

[51] Int. Cl.[3] ..... B65D 19/32; B65D 19/42; F16M 11/20

[52] U.S. Cl. ..... 108/51.1; 108/57.1; 248/188.8

[58] Field of Search ..... 108/56.3, 56.1, 51.1, 108/53.1-53.5, 55.1-55.5, 57.1; 206/386, 599, 600; 248/346, 188.8

[56] References Cited

U.S. PATENT DOCUMENTS

| | | | |
|---|---|---|---|
| 2,465,148 | 3/1949 | Coonen | 108/51.1 |
| 2,634,932 | 4/1953 | Withers | 108/51.1 |
| 2,918,241 | 12/1959 | Maher | 108/56.3 X |
| 3,702,100 | 11/1972 | Wharton | 108/53.3 |
| 4,128,253 | 12/1978 | Powers | 108/56.1 X |

FOREIGN PATENT DOCUMENTS

| | | | |
|---|---|---|---|
| 2502528 | 7/1976 | Fed. Rep. of Germany | 108/56.3 |
| 934005 | 8/1963 | United Kingdom | 108/57.1 |

*Primary Examiner*—William E. Lyddane

[57] ABSTRACT

A pallet post, which is adapted to be positioned between a plastic upper deck and a plastic lower deck of a pallet, is disclosed. The pallet post has a longitudinal axis, means for rotatably mounting the pallet post about the axis between the upper deck and the lower deck of a pallet, and at least three winglike arms which project radially from the axis. The winglike arms are substantially equally spaced about the axis and extend the length of the pallet post. The pallet post has the advantage that if struck by a tine of a fork lift truck, the post tends to rotate and to deflect the tine so that it passes the post without damaging the post or the plastic decks of the pallet between which the post is rotatably mounted.

19 Claims, 5 Drawing Figures

ROTATABLE PALLET POST FOR PLASTIC PALLETS

BACKGROUND OF THE INVENTION

1. Field of the Invention

The present invention relates to a pallet post and more particularly to a pallet post adapted to be rotatably mounted between a plastic upper deck and a plastic lower deck of a pallet.

The term "plastic" as used herein refers to a synthetic thermoplastic or thermosetting resin capable of being moulded into substantially rigid form.

2. Description of the Prior Art

Plastic pallets are known in the art, for example a flat plastic pallet for supporting bottle cases is disclosed in Canadian Pat. No. 1,022,859, which issued Dec. 20, 1977 to A. Schoeller et al.

In prior art plastic pallets, the pallet posts or supporting legs tend to be substantially rigidly fixed between the plastic upper and lower decks of the pallets. Although the pallet posts generally have smoothly curved outer surfaces they are substantially immovable. Hence, in the event that such a pallet post is accidentally struck by the tine of a fork lift truck the post itself may be sheared off or the plastic decks of the pallet may be damaged.

SUMMARY OF THE INVENTION

According to the present invention there is provided a pallet post adapted to be positioned between a plastic upper deck and a plastic lower deck of a pallet, the pallet post having a longitudinal axis, means for rotatably mounting the pallet post about said axis between the upper deck and the lower deck of the pallet, and at least three winglike arms projecting radially from the axis, the winglike arms being substantially equally spaced about the axis and extending longitudinally therealong.

BRIEF DESCRIPTION OF THE DRAWINGS

Embodiments of the present invention will be described in greater detail with reference to the accompanying drawings in which.

DETAILED DESCRIPTION OF THE INVENTION

Figure 1:
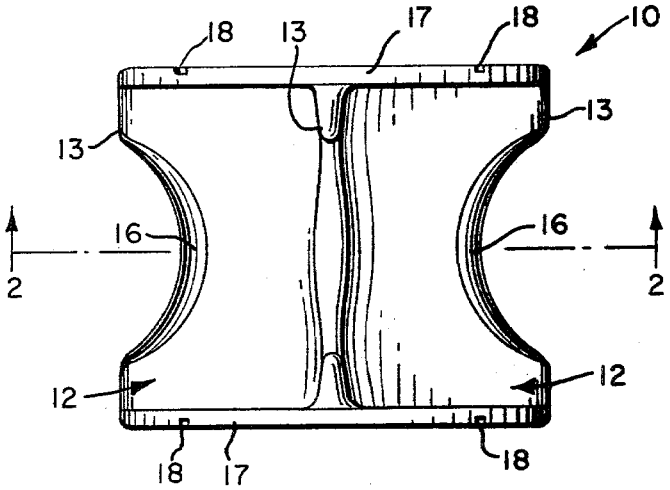
FIG. 1 is an elevation of a pallet post according to one embodiment of the invention.

Surprisingly, it has now been found that the above disadvantages in the prior pallet posts may be overcome by providing a rotatable pallet post which has winglike projections and smoothly curved surfaces such that if a tine of a fork lift truck strikes the post, the post tends to be rotated and the tine tends to be deflected so as to pass the post without damaging it or the plastic decks of the pallet.

In an embodiment of the present invention each winglike arm of the pallet post has an outer edge which has a smoothly curved convex surface when viewed from a direction parallel to the axis of the pallet post and each winglike arm is joined to each of its adjacent arms by a smoothly curved concave surface.

In another embodiment of the present invention the outer edge of each winglike arm has a concave surface at its mid portion when the winglike arm is viewed from a direction perpendicular to its radial plane passing through the axis of the pallet post.

In yet another embodiment of the present invention a disc is mounted at each end of the pallet post perpendicular to the axis thereof, each disc being rigidly attached to each of the winglike arms.

In yet another embodiment of the present invention the pallet post has three winglike arms.

In yet another embodiment of the present invention the pallet post has four winglike arms.

In yet another embodiment of the present invention at least one radial groove is provided in the outer surface of the disc at each end of the pallet post.

In yet another embodiment of the present invention the means for rotatably mounting the pallet post about its axis between the upper and lower decks of the pallet comprises a bolt hole adapted to carry a bolt.

In yet another embodiment of the present invention the means for rotatably mounting the pallet post about its axis between the upper and lower decks of the pallet comprises a projecting head at each end of the pallet post, the projecting heads having enlarged outer ends and being adapted to be inserted into recesses provided therefor in the upper and lower decks, the projecting heads being retained in the recesses by the enlarged outer ends.

In a further embodiment of the present invention the pallet post is a one-piece article moulded from plastic.

In a still further embodiment of the present invention the pallet post is a one-piece article moulded from polyethylene having a density of at least 0.955 g/cm$^3$.

The present invention also provides a pallet comprising a plastic upper deck, a plastic lower deck and a plurality of pallet posts rotatably mounted between the upper deck and the lower deck, each pallet post having a longitudinal axis, means for rotatably mounting the pallet post about said axis between the upper deck and the lower deck of the pallet, and at least three winglike arms projecting radially from the axis, the winglike arms being substantially equally spaced about the axis and extending longitudinally therealong.

In an embodiment of the present invention the pallet has four sides, four corners and a center and there are nine pallet posts rotatably mounted between the upper deck and the lower deck of the pallet, one at each of the four corners, one at each of the four sides, midway between the corners, and one at the center.

In another embodiment of the present invention the plastic upper deck and the plastic lower deck of the pallet are each one-piece articles moulded from polyethylene having a density of at least 0.955 g/cm$^3$.

Figure 2:
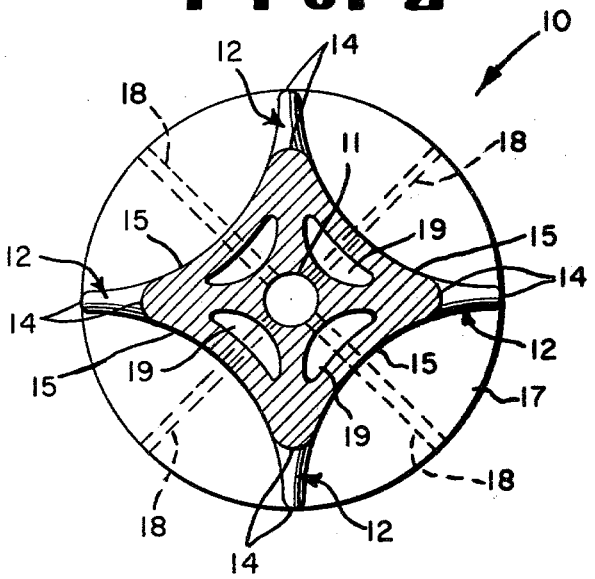
FIG. 2 is a sectional view of the pallet post of FIG. 1 viewed in the direction of arrows 2—2.

In the embodiment of the invention shown in FIGS. 1 and 2 of the drawings, a pallet post is designated generally by the numeral 10. Pallet post 10 is adapted to be rotatably mounted about its longitudinal axis on a bolt (not shown) through hole 11. Four equally spaced winglike arms 12 project radially from the axis of pallet post 10. Each winglike arm 12 has an outer edge 13 (see FIG. 1). Each outer edge 13 has a smoothly curved convex surface 14 when viewed from a direction parallel to the longitudinal axis of the pallet post (see FIG. 2). Each winglike arm 12 is joined to each of its adjacent arms (12) by a smoothly curved concave surface 15 (see FIG. 2). The outer edge 13 of each winglike arm 12 has a concave surface 16 at its mid portion (see FIG. 1) when the winglike arm 12 is viewed from a direction perpendicular to its radical plane passing through the axis of the pallet post 10. A disc 17 is mounted at each end of pallet post 10 perpendicular to the axis thereof. Each disc 17 is rigidly attached to each of the winglike arms 12. Four radial grooves 18 are provided in the outer surface of each disc 17. The radial grooves 18, which extend from hole 11 to the periphery of the disc 17, are provided to collect and transmit dirt etc. from the bearing surfaces of pallet post 10. Although radial grooves 18 are not essential it is preferred that at least one groove 18 be present on the outer surface of each disc 17. In the embodiment shown in FIGS. 1 and 2, the pallet post 10 is a one-piece article moulded from plastic. A preferred plastic is polyethylene having a density of at least 0.955 g/cm$^3$. For ease of moulding and to make the finished pallet post 10 lighter in weight it is convenient to provide voids 19 (see FIG. 2) extending the full length of the pallet post 10. It will be appreciated that voids 19 may be omitted and that a method other than moulding may be used to fabricate the pallet post 10, which need not be made from plastic. It will be appreciated that a pallet post 10 having three equally spaced winglike arms 12 instead of four will function satisfactorily as a rotatable pallet post.

Figure 3:
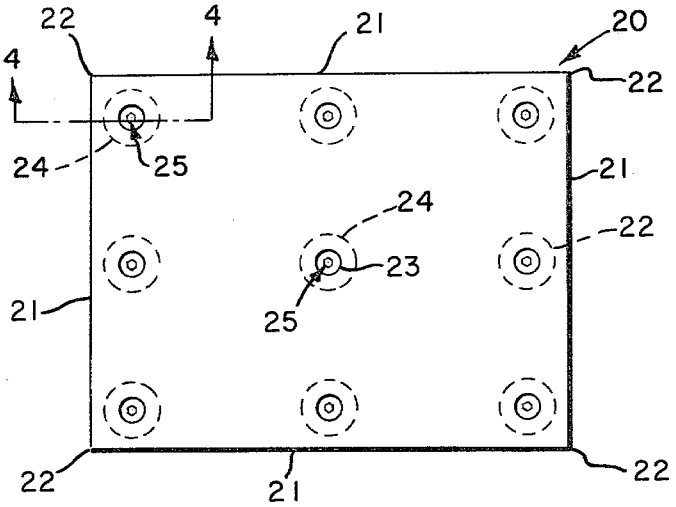
FIG. 3 is a plan view of a pallet according to one embodiment of the invention, the pallet having nine rotatably mounted pallet posts of the type shown in FIG. 1 and FIG. 2.
Figure 4:
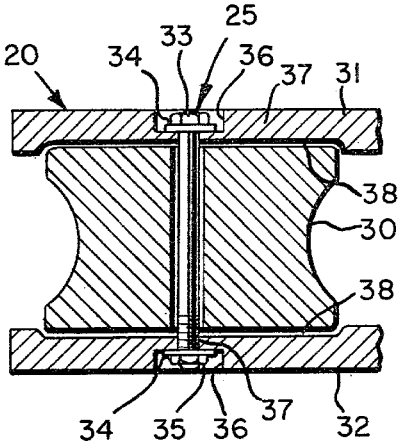
FIG. 4 is a partial section of the pallet of FIG. 3 showing of the nine pallet posts rotatably mounted on a bolt between the upper and lower decks of the pallet, the pallet post beng viewed in the direction of arrows 4—4 in FIG. 3.

In FIG. 3 a pallet is designated generally by the numeral 20. Pallet 20 has four sides 21, four corners 22 and a center 23. Nine pallet posts 24 (as shown in FIGS. 1 and 2 and described above) are rotatably mounted in pallet 20 on bolts 25, one at each of the four corners 22, one at each of the four sides 21, midway between the corners 22, and one at the center 23. FIG. 4, which is a partial section of the pallet 20 of FIG. 3, shows in detail how each of the pallet posts is rotatably mounted in pallet 20. In FIG. 4, a pallet post 30 is rotatably mounted about its longitudinal axis between plastic upper deck 31 and plastic lower deck 32 of pallet 20 on bolt 33. A washer 34 may be provided at each end of bolt 33 and the bolt 33 is held in place by a nut 35. Preferably a recess 36 is provided in the outer surface of each of upper deck 31 and lower deck 32 around each bolt hole 37 so that the head of bolt 33 and nut 35 do not project above the upper and lower surfaces of pallet 20. A disc-shaped indentation 38 may be provided in the inner surface of each of upper deck 31 and lower deck 32 around each bolt hole 37 such that each end of each pallet post 30 is slightly recessed into the upper deck 31 or the lower deck 32 of pallet 20. It will be appreciated that the disc-shaped indentations 38 may be omitted. Preferably the plastic upper deck 31 and the plastic lower deck 32 are each one-piece articles moulded from polyethylene having a density of at least 0.955 g/cm$^3$. It will be appreciated that plastic upper deck 31 may be identical to plastic lower deck 32.

Figure 5:
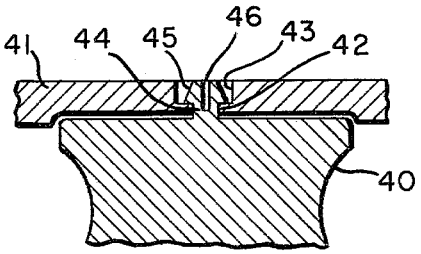
FIG. 5 is a partial section of a pallet and one pallet post according to one embodiment of the invention showing another means for rotatably mounting the pallet post between the upper and lower plastic decks of the pallet.

FIG. 5 shows a partial section of another embodiment of the invention in which different means are provided to rotatably mount each pallet post about its longitudinal axis in the pallet. In FIG. 5, a portion of a pallet post 40 is shown rotatably mounted in a portion of a plastic deck 41 of a pallet. A hole 42 is provided in plastic deck 41 and a recess 43 is provided in the outer surface of deck 41 around hole 42. A projecting head 44 having an enlarged outer end 45 is provided at each end of pallet post 40 (only one end being shown in FIG. 5). Two slots 46 (only one being visible in FIG. 5) in the form of a cross are provided in projecting head 44. Projecting head 44 is adapted to be inserted through hole 42 in recess 43 and to be retained in recess 43 by the enlarged outer end 45. The other end of pallet post 40 (not shown) is rotatably mounted in the other plastic deck (not shown) of the pallet in the same manner. It will be appreciated that in some circumstances the slots 46 may be omitted from projecting head 44 i.e. the enlarged outer end 45 of projecting head 44 may comprise a mushroom head.

What is claimed is:

1. A pallet post adapted to be positioned between a plastic upper deck and a plastic lower deck of a pallet, the pallet post having a longitudinal axis, means for rotatably mounting the pallet post about said axis between the upper deck and the lower deck of the pallet, and at least three winglike arms projecting radially from the axis and extending longitudinally therealong, the winglike arms being substantially equally spaced about the axis, with each of said arms being joined to an adjacent arm by a smoothly curved concave surface, and each arm having a smoothly curved convex surface along its outer edge when viewed from a direction parallel to the axis, and a concave surface at the mid portion of its outer edge when viewed from a direction perpendicular to its radial plane passing through the axis.

2. The pallet post of claim 1 wherein a disc is mounted at each end of the pallet post perpendicular to the axis thereof, each disc being rigidly attached to each of the winglike arms.

3. The pallet post of claim 2 wherein there are three winglike arms.

4. The pallet post of claim 2 wherein there are four winglike arms.

5. The pallet post of claim 4 wherein the means for rotatably mounting the pallet post about the axis between the upper and lower decks of the pallet comprises a bolt hole adapted to carry a bolt.

6. The pallet post of claim 4 wherein the means for rotatably mounting the pallet post about the axis between the upper and lower decks of a pallet comprises a projecting head at each end of the pallet post, the projecting heads having enlarged outer ends and being adapted to be inserted into recesses provided therefor in the upper and lower decks, the projecting heads being retained in the recesses by the enlarged outer ends.

7. The pallet post of claims 1, 2 or 5 wherein the pallet post is a one-piece article moulded from plastic.

8. The pallet post of claims 1, 2 or 5 wherein the pallet post is a one-piece article moulded from polyethylene having a density of at least 0.955 g/cm$^3$.

9. A pallet comprising a plastic upper deck, a plastic lower deck and a plurality of pallet posts rotatably mounted between the upper deck and the lower deck, each pallet post having a longitudinal axis, means for rotatably mounting the pallet post about said axis between the upper deck and the lower deck of the pallet, and at least three winglike arms projecting radially from the axis and extending longitudinally therealong, the winglike arms being substantially equally spaced about the axis, with each of said arms being joined to an adjacent arm by a smoothly curved concave surface, and each arm having a smoothly curved convex surface along its outer edge when viewed from a direction parallel to the axis and a concave surface at the mid portion of its outer edge when viewed from a direction perpendicular to its radial plane passing through the axis.

10. The plastic pallet of claim 9 wherein the pallet has four sides, four corners and a center, and wherein there are nine pallet posts rotatably mounted between the upper deck and the lower deck of the pallet, one at each of the four corners, one at each of the four sides, midway between the corners, and one at the center.

11. The pallet of claim 10 wherein a disc is mounted at each end of the pallet post perpendicular to the axis thereof, each disc being rigidly attached to each of the winglike arms.

12. The pallet of claim 11 wherein there are three winglike arms.

13. The pallet of claim 11 wherein there are four winglike arms.

14. The pallet of claim 13 wherein the means for rotatably mounting the pallet post about the axis between the upper and lower decks of the pallet comprises a bolt hole adapted to carry a bolt.

15. The pallet of claim 13 wherein the means for rotatably mounting the pallet post about the axis between the upper and lower decks of a pallet comprises a projecting head at each end of the pallet post, the projecting heads having enlarged outer ends and being adapted to be inserted into recesses provided therefor in the upper and lower decks, the projecting heads being retained in the recesses by the enlarged outer ends.

16. The pallet of claims 9, 11 or 14 wherein the pallet post is a one-piece article moulded from plastic.

17. The pallet of claims 9, 11 or 14 wherein the pallet post is a one-piece article moulded from polyethylene having a density of at least 0.955 g/cm$^3$.

18. The pallet of claims 9, 11 or 14 wherein the plastic upper deck and the plastic lower deck are each one-piece articles moulded from polyethylene having a density of at least 0.955 g/cm$^3$.

19. A pallet post adapted to be positioned between a plastic upper deck and a plastic lower deck of a pallet, the pallet post having a longitudinal axis, means for rotatably mounting the pallet post about said axis between the upper deck and the lower deck of the pallet, four winglike arms projecting radially from the axis and extending longitudinally therealong, the winglike arms being substantially equally spaced about the axis with each of said arms being joined to an adjacent arm by a smoothly curved concave surface, each arm having a smoothly curved convex surface along its outer edge when viewed from a direction parallel to the axis and a concave surface at mid portion of its outer edge when viewed from a direction perpendicular to its radial plane passing through the axis, and a disc mounted and rigidly attached at each end of the pallet post perpendicular to the axis, each disc being provided with at least one radial groove in its outer surface.

* * * * *

UNITED STATES PATENT AND TRADEMARK OFFICE

CERTIFICATE OF CORRECTION

PATENT NO. : 4,292,900

DATED : October 6, 1981

INVENTOR(S) : RUSSELL P. BULA

It is certified that error appears in the above—identified patent and that said Letters Patent is hereby corrected as shown below:

On the printed face sheet of the patent, the Assignee reading "E. I. du Pont de Nemours and Company, Wilmington, Del." should read --Du Pont Canada Inc., Montreal, Canada--.

Signed and Sealed this

*Ninth* Day of *March 1982*

[SEAL]

*Attest:*

GERALD J. MOSSINGHOFF

*Attesting Officer*

*Commissioner of Patents and Trademarks*